US008858176B1

(12) United States Patent
Liang

(10) Patent No.: US 8,858,176 B1
(45) Date of Patent: Oct. 14, 2014

(54) TURBINE AIRFOIL WITH LEADING EDGE COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 504 days.

(21) Appl. No.: 13/324,017

(22) Filed: Dec. 13, 2011

(51) Int. Cl.
*F01D 5/18* (2006.01)

(52) U.S. Cl.
USPC ..... 416/97 R

(58) Field of Classification Search
USPC ..... 415/115; 416/97 R
See application file for complete search history.

(56) References Cited

U.S. PATENT DOCUMENTS 4,669,957 A * 6/1987 Phillips et al. ..... 416/97 R
5,975,851 A * 11/1999 Liang ..... 416/97 R
6,139,269 A * 10/2000 Liang ..... 416/97 R
6,981,846 B2 * 1/2006 Liang ..... 416/97 R
6,994,521 B2 * 2/2006 Liang ..... 416/97 R
7,798,776 B1 * 9/2010 Liang ..... 416/97 R
7,866,948 B1 * 1/2011 Liang ..... 416/97 R
2006/0073016 A1 * 4/2006 Liang ..... 416/97 R
2010/0068033 A1 * 3/2010 Liang ..... 415/115

* cited by examiner

*Primary Examiner* — Igor Kershteyn
*Assistant Examiner* — Aaron R Eastman
(74) *Attorney, Agent, or Firm* — John Ryznic

(57) ABSTRACT

An air cooled turbine blade with a leading edge region cooling circuit that includes a row of vortex chambers connected to a cooling air supply cavity, with each vortex chamber connected to a showerhead arrangement of metering and curved diffusion holes that meter and diffuse cooling air prior to discharge onto the blade surface. Thin metering slots supply cooling air to the vortex chambers to promote a vortex flow. The vortex chambers and metering and curved diffusion holes are formed from a metal printing process that cannot be formed using a ceramic core with an investment casting process.

15 Claims, 4 Drawing Sheets view A-A
Prior Art view B-B
Prior Art

TURBINE AIRFOIL WITH LEADING EDGE COOLING

CROSS-REFERENCE TO RELATED APPLICATIONS

None.

GOVERNMENT LICENSE RIGHTS

None.

BACKGROUND OF THE INVENTION

1. Field of the Invention

The present invention relates generally to a gas turbine engine, and more specifically to an air cooled turbine airfoil with leading edge film cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

The leading edge of the airfoil is exposed to the highest gas flow temperature and therefore requires the most amount of cooling. FIGS. 1 and 2 shows a prior art turbine blade with the leading edge region being cooled using a showerhead arrangement of film cooling holes 11 and two rows of gill holes. Cooling air is delivered to a supply channel and flows through a row of metering and impingement holes 13 to produce impingement cooling on the backside surface of the leading edge wall. The spent impingement cooling air then flows through the film cooling holes and gill holes to provide a layer of film cooling air on the outer surface of the leading edge region.

The showerhead film cooling holes 11 are supplied with cooling air from a common impingement channel and discharged at various gas side pressures. Because of this prior art design, the cooling flow distribution and pressure ratio across the showerhead film holes for the pressure and suction side film rows is predetermined by the impingement channel pressure. Also, the standard film holes pass straight through the airfoil wall at a constant diameter and exit the airfoil at an angle to the surface. Some of the coolant is subsequently injected directly into the mainstream gas flow causing turbulence, coolant dilution and loss of downstream film cooling effectiveness. And, the film hole breakout on the airfoil surface may induce stress issues in the blade cooling application.

The prior art blade includes three rows of film holes in the showerhead arrangement. The middle row of film holes is positioned at the airfoil stagnation point where the highest heat loads is located on the airfoil leading edge region. Film cooling holes for each film row are inclined at 20 to 35 degrees toward the blade tip as seen in FIG. 3. A major disadvantage of this prior art design is an over-lapping of film cooling air ejection flow in a rotational environment (in a rotor blade) and low through-wall convection area as well as heat transfer augmentation. This prior art film cooling hole arrangement and design results in the appearance of hot streaks 16 on the airfoil surface because the cooling air flow from the middle row flows over the film cooling holes on the outer rows without flow over the space between adjacent film holes in the same row as seen in FIG. 4.

The prior art blade with showerhead film cooling holes is formed by an investment casting process that uses a ceramic core to form the internal cooling air passages and features. The film cooling holes are then drilled into the solid metal blade using a process such as laser drilling or EDM drilling. Because of the limitations of the ceramic core is forming cooling air passages and features, hole diameters are limited to no smaller than around 1.3 mm because the ceramic piece would break when the liquid metal flows around the ceramic core.

BRIEF SUMMARY OF THE INVENTION

An air cooled turbine blade with a leading edge region cooling circuit that includes vortex chambers extending in a spanwise direction and connected to a cooling air supply cavity through thin metering slots. Each vortex chamber is connected to a showerhead arrangement of metering and curved diffusion holes that discharge cooling air onto the airfoil surface.

The vortex chambers and the metering and curved diffusion holes are formed from a metal printing process that can produce very small features and cooling holes that cannot be formed using a ceramic core with an investment casting process. Improved cooling efficiency can be produced because of the micro cooling circuits in the present invention and less cooling air can be used than in the prior art ceramic core investment casting process used to form prior art blades.

DETAILED DESCRIPTION OF THE INVENTION

The present invention is a turbine blade with a leading edge region cooling circuit that includes vortex cooling chambers and curved diffusion holes that open onto a surface of the blade. The cooling air features of the present invention are produced using a metal printing process which can print a metal part with very small cooling air holes that cannot be formed from a ceramic core in investment casting. The metal printing process can also produce a porous metal part in which air can flow through the metal part from one side to the other side.

Figure 1:
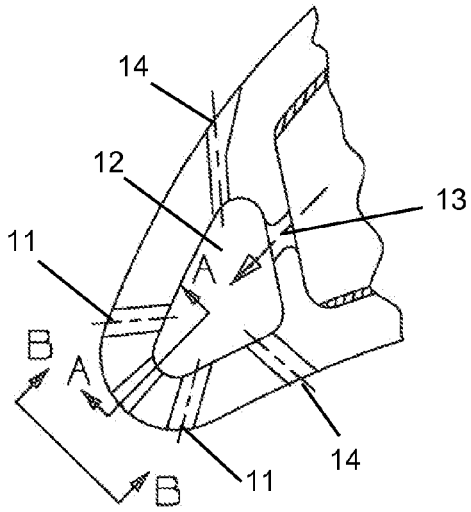
FIG 1 Prior Art
FIG. 1 shows a cross section top view of a leading edge region of the blade with an arrangement of film cooling holes and gill holes for a prior art blade.
Figure 2:
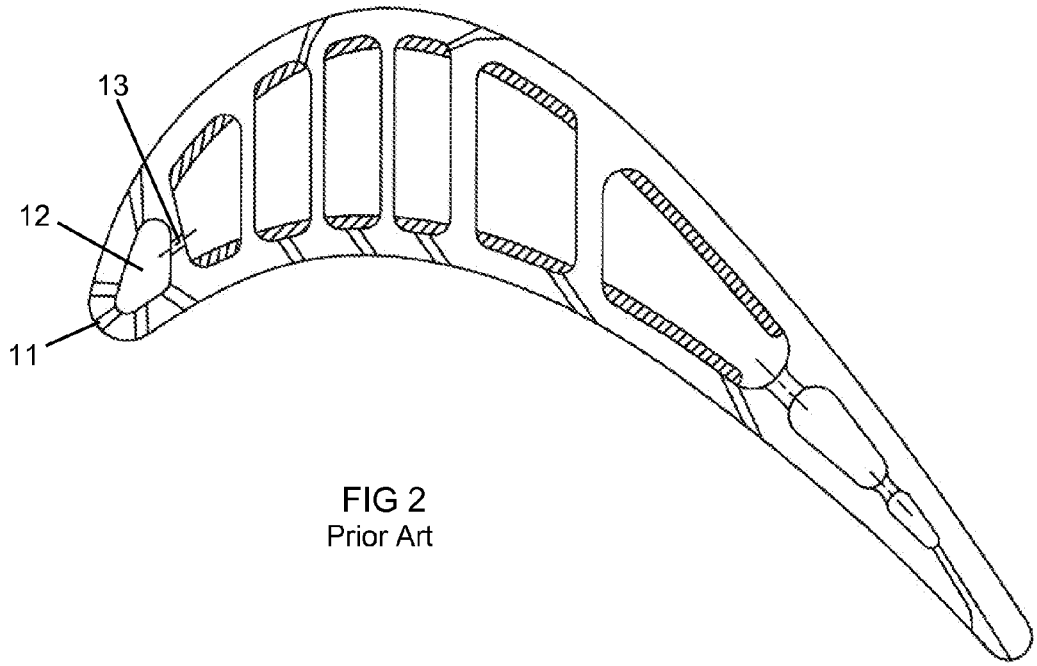
FIG 2 Prior Art
FIG. 2 shows a cross section top view of the prior art blade with a cooling circuit and the leading edge region cooling circuit of FIG. 1.
Figure 3:
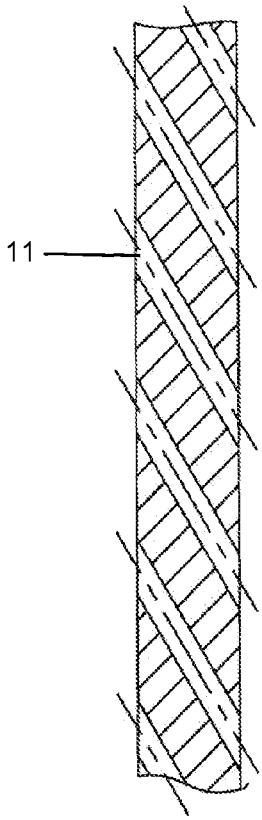
FIG. 3 shows a cross section side view through a row of film cooling holes in the leading edge region of the FIG. 1 blade.
Figure 4:
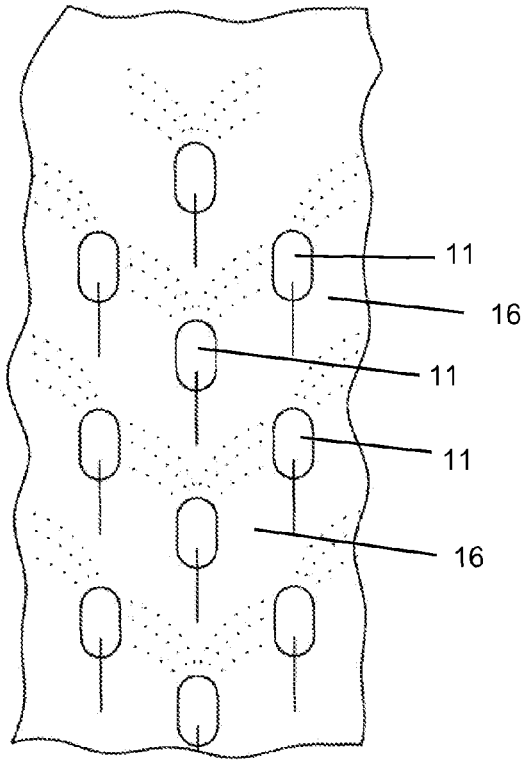
FIG. 4 shows a front view of the showerhead arrangement of film cooling holes of FIG. 1 with the resulting overlapping flow of cooling air for a blade of the prior art FIG. 1.
Figure 5:
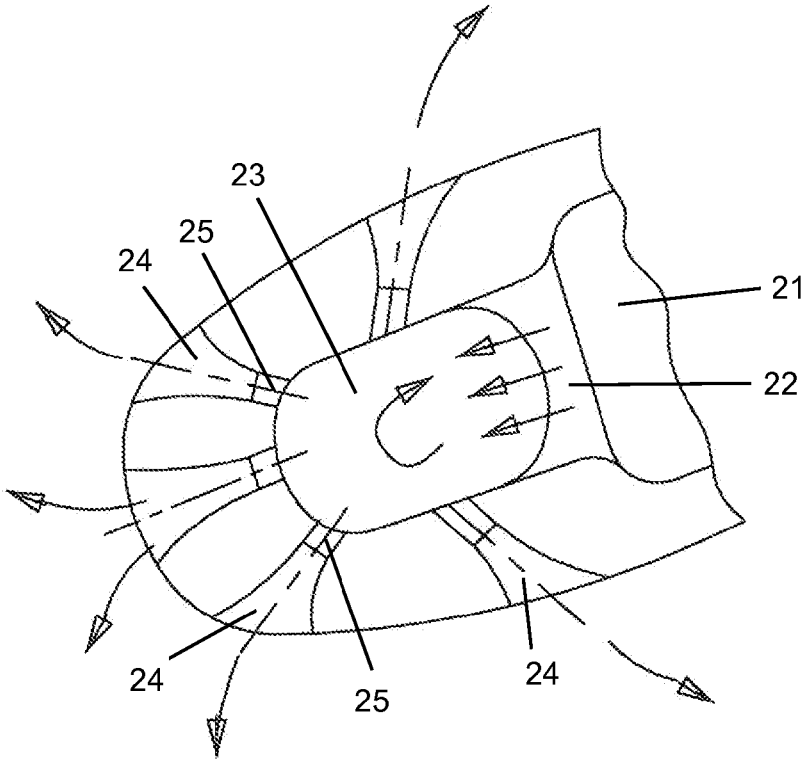
FIG. 5 shows a cross section top view for a leading edge region of a turbine blade with the leading edge region cooling circuit of the present invention.

FIG. 5 shows a leading edge region with the cooling circuit of the present invention. A cooling air supply cavity 21 supplies cooling air to the blade from an external source. The cooling air supply cavity 21 is connected to a row of vortex chambers 23 through a thin metering slot 22. A number of metering and diffusion holes are connected to the vortex chambers 23 and open around the leading edge region of the blade to discharge film cooling air. Each metering and diffusion hole includes a metering inlet hole 25 and a curved diffusion hole or slot 24 with the curved diffusion holes opening onto the surface of the blade. In the FIG. 5 embodiment, the blade includes a showerhead arrangement of three metering and diffusion holes and two gill holes located on the pressure and suction side walls downstream from the showerhead film holes. The gill holes also have the same structure as the showerhead film holes with a metering inlet hole 25 followed by a curved diffusion hole 24 which is at a compound angle orientation relative to the blade.

Figure 6:
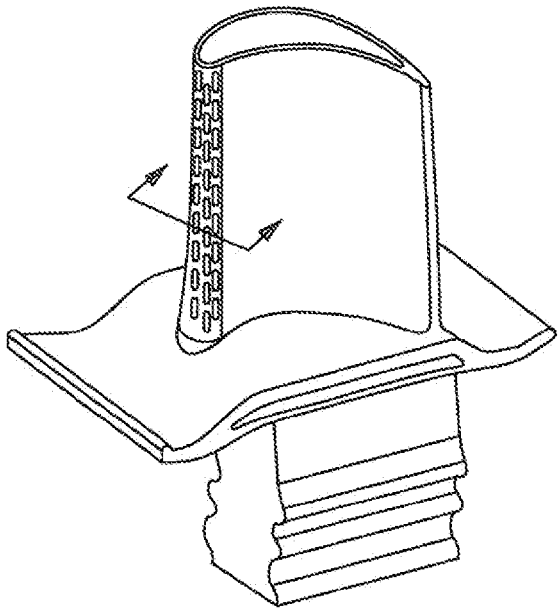
FIG. 6 shows an isometric view of a turbine rotor blade with the leading edge cooling circuit of the present invention.

FIG. 6 shows an isometric view of the blade with the diffusion holes 24 opening onto the leading edge region surface. The diffusion holes have a narrow width and a tall radial height and with adjacent rows of diffusion holes 24 staggered in the chordwise direction of the blade.

Figure 7:
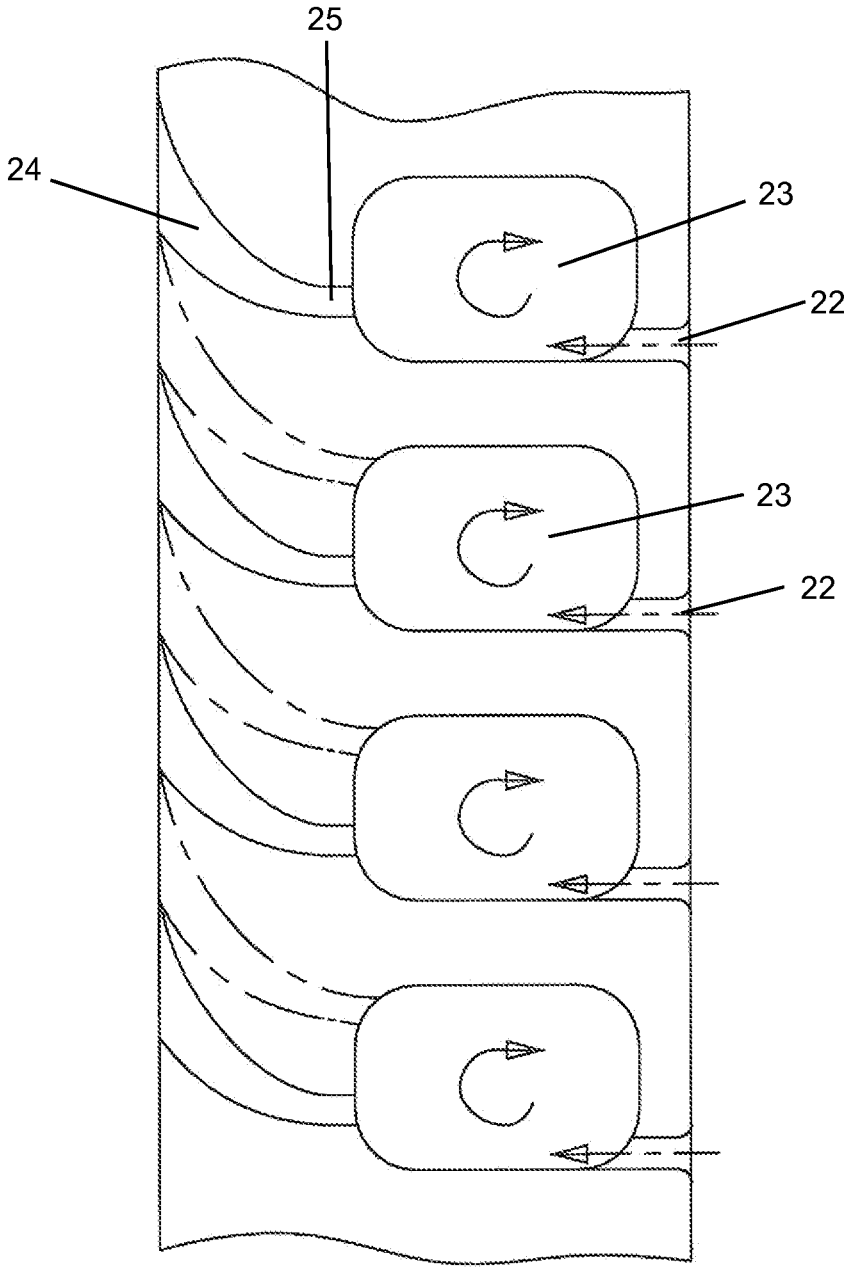
FIG. 7 shows a cross section side view of the leading edge region cooling circuit of the present invention.

FIG. 7 shows a side view of one row of the metering and diffusion holes in a section of the blade leading edge region. The cooling air supply cavity 21 is connected to individual vortex chambers 23 that extend along the radial or spanwise direction of the leading edge region from the platform section to the blade tip section. Each vortex chamber 23 is connected to the cooling air supply cavity 21 by a thin metering slot 22 that has the same width as the vortex chamber 23 but could be thinner. The thin metering slots 22 open into the vortex chambers 23 parallel and even with a bottom surface of the vortex chamber 23 in order to produce a vortex flow of the cooling air within the vortex chambers 23 are represented by the curved arrows. The curved metering and diffusion holes 25 and 24 are connected to the vortex chambers 23 at an opposite side and offset from the thin metering slots 22 in order to prevent the cooling air from flowing straight through the vortex chambers 23 but to flow around the vortex chambers 23 as much as possible in order to increase the heat transfer efficiency. As seen in FIG. 7, adjacent curved metering and diffusion holes are offset or staggered in the blade spanwise direction as represented by the dashed lines. This is also shown in FIG. 6.

The curved diffusion hole or slot with compartmental vortex chamber cooling device is constructed in a small module formation. Individual modules are designed based on a gas side discharge pressure in the spanwise directions as well as designed at a desire coolant flow distribution for the leading edge film holes. Metering slots for each vortex chamber 23 can be altered in the blade spanwise direction for the control of cooling flow and overall pressure drop across the entire film slot. Typical vortex chamber 23 height relative to the thin metering slot 22 height is at the range of 6 to 12 times.

The cooling air is metered into the vortex chambers 23. The cooling air is metered again at the entrance to each small individual curved diffusion film cooling slots through the metering inlet holes 25. The curved section in the diffusion slots 24 changes the cooling air flow direction and thus changes the cooling air momentum. This change of cooling flow direction within the film cooling diffusion slot 24 allows the cooling air to diffuse uniformly at the slot break out and reduces the cooling air exit momentum. Coolant penetration into the gas path is thus minimized; yielding good build-up of the coolant sub-boundary layer next to the airfoil surface, better film coverage in the chordwise and spanwise directions for the airfoil leading edge region is achieved.

In addition to better control of coolant flow, enhanced leading edge film cooling, and minimized stress induced by the film holes, the change of cooling flow direction of cooling air in each individual metering curved film cooling hole 24 enhances the heat transfer augmentation for the airfoil leading edge internal convection capability. Also, the elongated discrete slots 24 breakout for the showerhead rows reduces the amount of the hot gas surface thus translate to a reduction of airfoil total heat load into the airfoil leading edge region. The high velocity vortex flow within the vortex chambers of the present invention also enhances the blade leading edge backside convective cooling capability compared to the prior art impingement cooling cavity.

For the manufacture of this particular metering vortex chamber with curved diffusion film cooling slot, the conventional EDM (Electric Discharge Machining) drilling process will not be able to form this complicated cooling geometry. The EDM drilling process for film cooling hole requires a straight line of sight between the film cooling inlet and exit. In order to fabricate this metering vortex chamber and curved diffusion slots of the present invention, the metal printing parts process is used to form the complicated blade leading edge cooling configuration of the present invention. The metal printing process is capable of printing cooling air holes much smaller in diameter than the minimum size of 1.3 mm of the investment casting process that uses the ceramic core. Also, this metal printing process can form complex features and shapes that cannot be formed from a ceramic core because of the pulling direction of the mold used to form the ceramic core.

In operation, cooling air is supplied through the airfoil leading edge flow cavity 21, metering through the thin metering slot 22 and into the vortex chambers 23 to generate vortices cooling air within the vortex chambers 23 on the backside of the blade leading edge. Cooling air within the vortex chambers 23 is metered through the metering holes 25 and into the curved diffusion slots 24 where the cooling air is diffused prior to discharge onto the airfoil surface. Spent air finally discharge from airfoil and forming a film sub-layer for the cooling of airfoil leading edge region.

In summary, the new blade leading edge backside vortex cooling and curved metering diffusion film cooling slot arrangement increases the blade leading edge cooling effectiveness to the level above the conventional backside impingement cooling with straight film hole achievable level. The metering entrance region to the vortex chamber, enhanced convective cooling for the vortex chamber, the curved diffusion section within the film slots improves overall convection capability, lower the through wall thermal gradient, which reduces the blade leading edge metal temperature.

I claim the following:

1. An air cooled turbine blade comprising:

a leading edge region;

a pressure side wall and a suction side wall extending from the leading edge region;

a cooling air supply cavity located adjacent to the leading edge region;

a vortex chamber located between the leading edge of the blade and the cooling air supply cavity;

a metering slot connecting the cooling air supply cavity to the vortex chamber;

the metering slot having a width greater than a height in a spanwise direction of the turbine blade; and, a metering and diffusion hole connected to the vortex chamber with an outlet opening onto a surface of the leading edge region of the turbine blade.

2. The air cooled turbine blade of claim 1, and further comprising:

the metering slot opens into the vortex chamber parallel to and even with a bottom surface of the vortex chamber.

3. The air cooled turbine blade of claim 1, and further comprising:

the diffusion hole is a curved diffusion hole.

4. The air cooled turbine blade of claim 1, and further comprising:

the diffusion hole is a radial upward curved diffusion hole.

5. The air cooled turbine blade of claim 1, and further comprising:

a plurality of metering and diffusion holes connected to the vortex chamber; and, the plurality of metering and diffusion holes forming a showerhead arrangement of cooling air holes for the leading edge region of the blade.

6. The air cooled turbine blade of claim 5, and further comprising:

the plurality of metering and diffusion holes is offset in a spanwise direction of the blade.

7. The air cooled turbine blade of claim 5, and further comprising:

the openings of the diffusion holes have a radial height much greater than a width.

8. The air cooled turbine blade of claim 1, and further comprising:

a plurality of vortex chambers each connected to the cooling air supply cavity and extending in a spanwise direction of the blade; and, a metering and diffusion hole connected to each of the vortex chambers and opening onto a surface of the blade.

9. The air cooled turbine blade of claim 8, and further comprising:

the plurality of vortex chambers each form a vortex flow having a rotational axis perpendicular to a spanwise direction of the turbine blade.

10. The air cooled turbine blade of claim 1, and further comprising:

a plurality of metering and diffusion holes connected to each of the vortex chambers; and, the plurality of metering and diffusion holes forming a showerhead arrangement of cooling air holes for the leading edge region of the blade.

11. The air cooled turbine blade of claim 1, and further comprising:

the metering and diffusion hole has a diffusion in both a spanwise direction and a chordwise direction of the turbine blade.

12. A turbine rotor blade comprising:

an airfoil extending from a platform;

the airfoil having a leading edge region;

a row of vortex chambers located in the leading edge region;

each vortex chamber being separated from adjacent vortex chambers and forming a vortex flow path perpendicular to a spanwise direction of the turbine rotor blade;

a cooling air supply cavity located adjacent to the leading edge region of the turbine rotor blade;

a metering slot connecting each of the row of vortex chambers to the cooling air supply cavity;

each metering slot having a width greater than a height in the spanwise direction of the turbine rotor blade; and, a plurality of metering and diffusion holes connected to each of the vortex chambers and opening onto a surface of the leading edge region of the turbine rotor blade.

13. The turbine rotor blade of claim 12, and further comprising:

the plurality of metering and diffusion holes each are curved in an upward direction of the turbine rotor blade.

14. The turbine rotor blade of claim 12, and further comprising:

the plurality of metering and diffusion holes each have a diffusion in both a spanwise direction and a chordwise direction of the turbine rotor blade.

15. The turbine rotor blade of claim 12, and further comprising:

the metering slots are directed to discharge cooling air parallel to a bottom surface of the vortex chamber.

* * * * *